US007533506B2

(12) United States Patent
Platt

(10) Patent No.: US 7,533,506 B2
(45) Date of Patent: May 19, 2009

(54) BRACKET FOR MOUNTING AND VERTICALLY LEVELING A POST ON A SURFACE

(76) Inventor: Robert E. Platt, 8701 Highland Ave., Mineral Ridge, OH (US) 44440

( * ) Notice: Subject to any disclaimer, the term of this patent is extended or adjusted under 35 U.S.C. 154(b) by 369 days.

(21) Appl. No.: 11/330,008

(22) Filed: Jan. 11, 2006

(65) Prior Publication Data

US 2007/0158526 A1 Jul. 12, 2007

(51) Int. Cl.
*E02D 27/32* (2006.01)

(52) U.S. Cl. ..... 52/296; 52/720.2

(58) Field of Classification Search ..... 248/519, 248/650, 656, 188.4, 371, 393, 396, 398; 52/170, 296, 720.2, 736.1, 736.3, 736.4, 52/737.5, 738.1

See application file for complete search history.

(56) References Cited

U.S. PATENT DOCUMENTS 4,302,962 A * 12/1981 Williams ..... 73/1.75
5,770,823 A * 6/1998 Piroozmandi ..... 177/1
6,141,928 A 11/2000 Platt
6,247,677 B1 * 6/2001 Vinet et al. ..... 249/189
6,718,710 B2 4/2004 Platt
7,188,821 B2 * 3/2007 Curtis ..... 248/683

* cited by examiner

*Primary Examiner*—Korie Chan
(74) *Attorney, Agent, or Firm*—Sand & Sebolt

(57) ABSTRACT

A mounting bracket for mounting a post on a planar surface such as a deck. The mounting bracket is used with posts which include an inner support integrally formed with an adjustment plate and having a vinyl sleeve slipped thereover. The mounting bracket comprises a trim assembly which includes a peripheral wall and a movable portion disposed inwardly of the peripheral wall. The movable portion may be one or more flexible tabs formed in a floor of the trim assembly, a base plate inserted into abutting contact with the floor of the trim assembly or one or more flexible tabs formed in a base plate which is then inserted into a recessed area in the trim assembly. The movable portion is moved relative to the peripheral wall of the trim assembly by an adjustment device. In the preferred embodiment of the invention, the adjustment devices comprise a plurality of bolts that are selectively rotatable in one or more of a first and a second direction. As the bolts are rotated, the movable portion, is raised or lowered relative to the peripheral wall of the trim assembly, thereby causing a change in the orientation of the adjustment plate.

27 Claims, 13 Drawing Sheets

BRACKET FOR MOUNTING AND VERTICALLY LEVELING A POST ON A SURFACE

BACKGROUND OF THE INVENTION

1. Technical Field

This invention generally relates to fencing systems. More particularly, the invention relates to mounting brackets useful for installing posts for deck railings. Specifically, the invention relates to a device for mounting and vertically leveling a post on a planar surface.

2. Background Information

Vinyl fencing has become popular because of its durability and aesthetic appeal. Vinyl fence posts that are installed in the ground are typically installed in a manner similar to wood fence posts. A hole is dug and the post is vertically leveled and concrete is used to set the post in place. Installing vinyl posts on decks, patios or other planar surfaces is more difficult because the post needs to be vertically leveled otherwise any railing secured thereto takes on an aesthetically unappealing appearance.

The present inventor has addressed this problem in two previous patents, namely U.S. Pat. No. 6,141,928 and 6,718,710. In both of these patents, the inventor has provided a mounting bracket into which the bottom end of the post is inserted. The post is also provided with an adjustment plate that is integrally connected to the bottom end of the post support and the adjustment plate is received within the mounting bracket. The vertical position of the post support is adjusted by selectively rotating a plurality of adjustment bolts that are threadably received through the adjustment plate, through the mounting bracket base and into engagement with a bearing plate disposed under the mounting bracket on the planar surface. When the bolts are rotated in a first direction, the adjustment plate is forced upwardly away from the bearing plate and when the bolts are rotated in a second direction, the adjustment plate moves downwardly toward the planar surface. The adjustment bolts are rotated to alter the orientation of the post support until it is plumb with the vertical direction. When the adjustment bolts are rotated, the orientation of the adjustment plate and the mounting bracket, is altered. If the adjustment of the bolts is sufficiently large, the mounting bracket can be partially lifted off the deck surface, causing a gap to be formed between the bracket and the deck surface. This gives the post and the railing attached thereto a less finished and therefore less aesthetically appealing appearance.

There is therefore a need in the art for a device for installing and leveling a post that will allow the mounting bracket to stay substantially in contact with the planar surface upon which the post is being installed.

SUMMARY OF THE INVENTION

The device of the present invention is a mounting bracket which may be used to mount a post on a surface such as a deck. The bracket is designed for use with a post that preferably includes an inner metal support surrounded by a vinyl sleeve. An adjustment plate is integrally formed with the metal support. The mounting bracket of the present invention comprises a trim assembly which includes a peripheral wall and a movable portion disposed inwardly of the peripheral wall. The movable portion may be one or more flexible tabs formed in a floor of the trim assembly, a base plate inserted into abutting contact with the floor of the trim assembly or one or more flexible tabs formed in a base plate which is then inserted into a recessed area in the trim assembly. The movable portion is moved relative to the peripheral wall of the trim assembly by an adjustment device. In the preferred embodiment of the invention, the adjustment devices comprise a plurality of bolts that are selectively rotatable in one or more of a first and a second direction. As the bolts are rotated, the movable portion is raised or lowered relative to the peripheral wall of the trim assembly, thereby causing a change in the orientation of the adjustment plate. The mounting bracket of the present invention may also include a bearing plate and a securement plate that are used in conjunction with the trim assembly and movable portion. The mounting bracket enables an installer to make adjustments in the orientation of the post support by selectively engaging one or more of the adjustment devices on the mounting bracket. Once the post support is vertically leveled, it is secured to the surface in that orientation and the vinyl sleeve is then slipped into place.

BRIEF DESCRIPTION OF THE DRAWINGS

The preferred embodiments of the invention, illustrative of the best mode in which applicant has contemplated applying the principles, are set forth in the following description and are shown in the drawings and are particularly and distinctly pointed out and set forth in the appended claims.

DETAILED DESCRIPTION OF THE INVENTION

Figure 1:
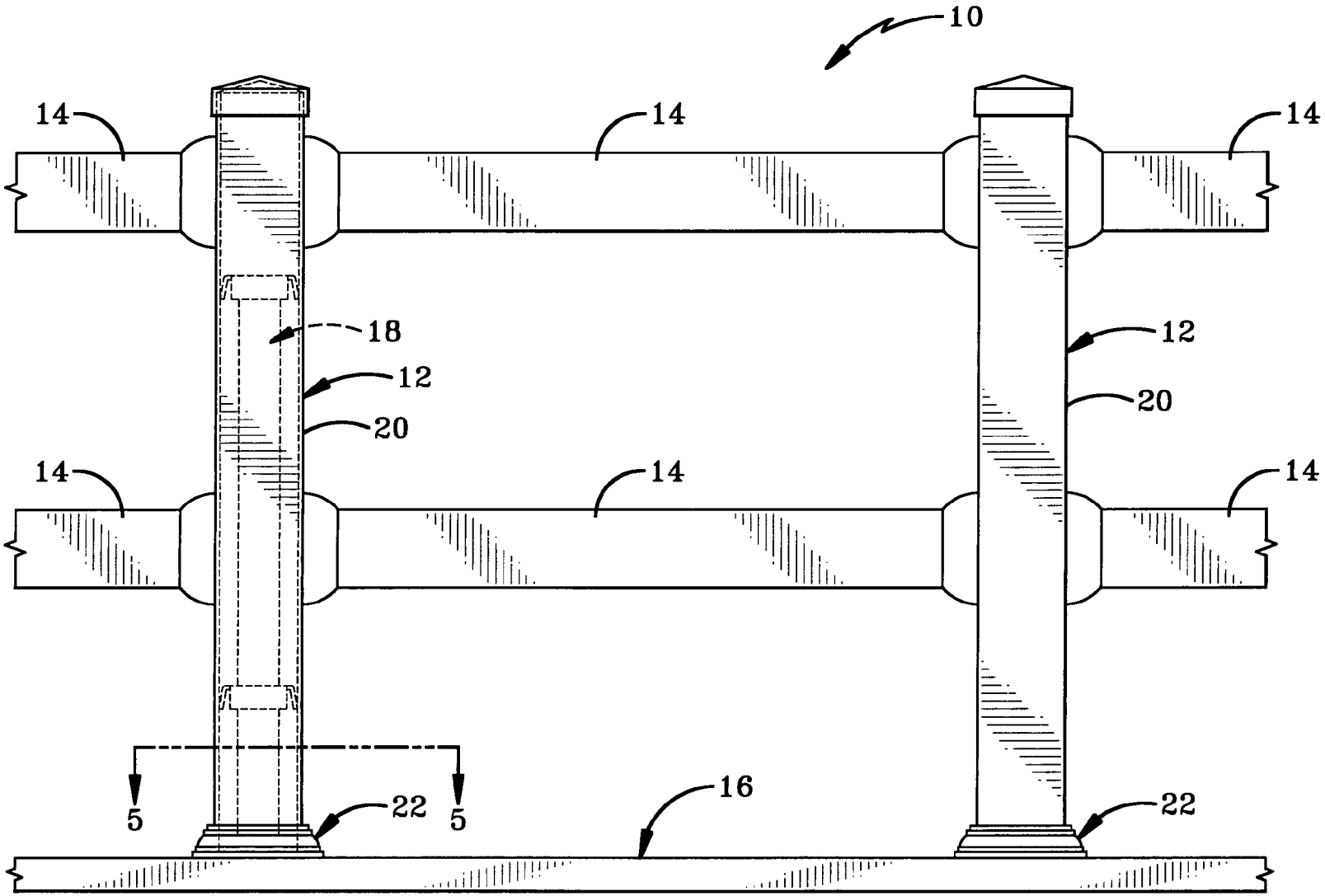
FIG. 1 is a side elevational view of a deck railing constructed using the mounting bracket of the instant invention.

Referring to FIG. 1, there is shown a deck railing or fence, generally indicated at 10, which includes a plurality of vertically-disposed posts 12 and horizontally-disposed rails 14. Posts 12 are mounted onto a planar surface 16, such as deck planking or boards and posts 12 and rails 14 are connected together in any suitable manner known in the art. Posts 12 preferably are of the type comprising an inner metal support 18 having a vinyl sleeve 20 surrounding the same. Support 18 and sleeve 20 are mounted to surface 16 by way of a mounting bracket in accordance with the present invention.

Referring to FIGS. 2-6, there is shown a first embodiment of a mounting bracket in accordance with the present invention, and generally indicated at 22. Mounting bracket 22 comprises a base plate 24 having a peripheral wall 26 extending upwardly and outwardly away therefrom. Base plate 24 and peripheral wall 26 preferably are formed as a unitary component and preferably are manufactured from vinyl.

Base plate 24 has an upper face 24*a* and a lower face 24*b* and peripheral wall 26 extends upwardly and outwardly away from upper face 24*a*. Upper face 24*a* thereby forms the floor of a recessed area within mounting bracket 22 as may be seen from FIG. 4. Peripheral wall 26 has an inner surface 26*a*, an outer surface 26*b* and an upper ledge 26*c* connecting the two together. The inner surface 26*a* is substantially vertical and is shaped and sized to abut vinyl sleeve 20 when sleeve 20 is received within mounting bracket 22. Outer surface 26*b* of peripheral wall 26 is formed with a decorative trim-type profile (FIG. 4) which gives mounting bracket 22 an aesthetically pleasing appearance and thereby gives the installed post 12 a finished look.

Figure 2:
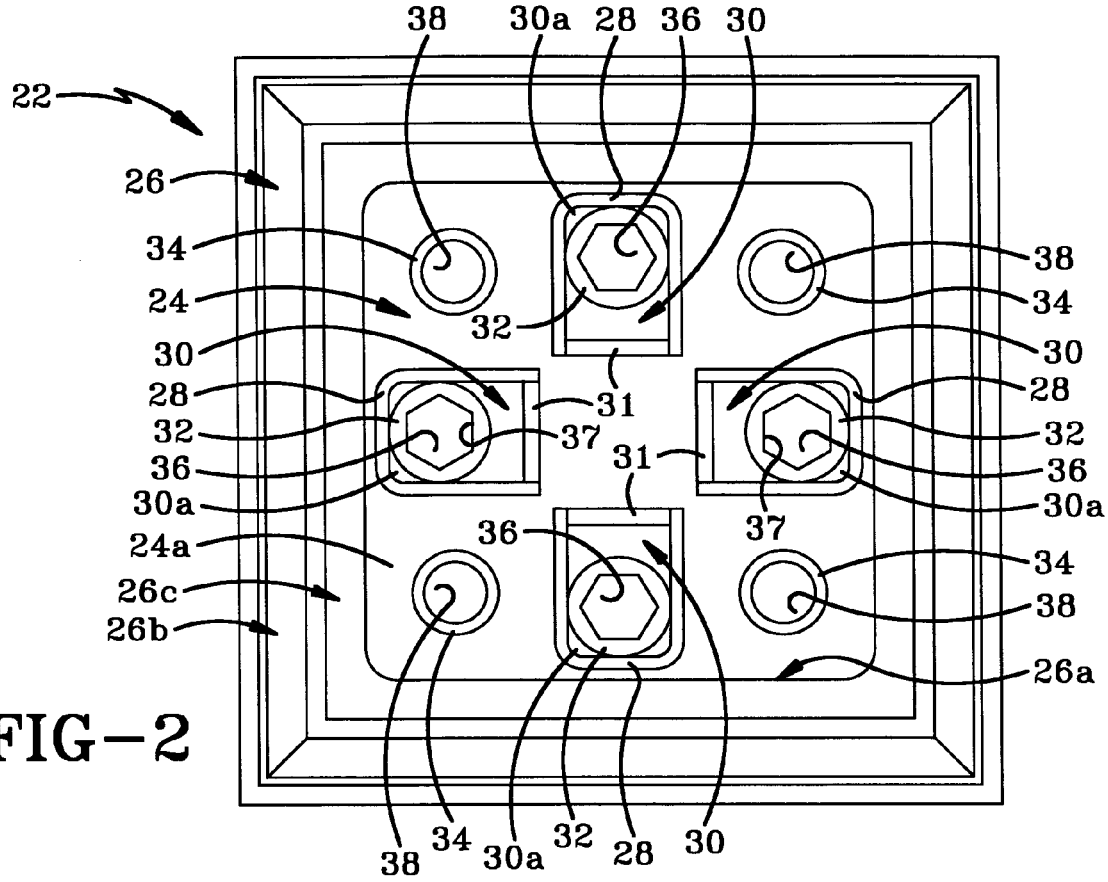
FIG. 2 is top view of a first embodiment of a mounting bracket in accordance with the present invention.

As may be seen in FIG. 2, and in accordance with a specific feature of the present invention, base plate 24 includes four U-shaped slots 28 cut therein in a substantially cross-shaped formation. Each slot 28 defines a flexible and deflectable tab 30 which is connected to base plate 24 along one side. A groove 31 is formed along the side where tab 30 remains connected to base plate 24. Groove 31 forms a line of weakness along which a free end 30*a* of tab 30 may be deflected upwardly and downwardly out of alignment with upper face 24*a* of base plate 24. A plurality of first bosses 32 and second bosses 34 are integrally formed on base plate and extend upwardly and outwardly away from the upper face 24*a* thereof. Each first boss 32 is disposed on one of the flexible tabs 30. More particularly, boss 32 is disposed proximate the free end 30*a* of tab 30. Each first boss 32 has an axial bore 36 defined therein, with bore 36 being substantially hexagonal in cross-sectional shape. As will be understood, bores 38 may, alternatively, be of any other desired cross-sectional shape. Furthermore, a lip 37 (FIG. 3) extends inwardly over at least a portion of each bore 36, thereby slightly decreasing the dimensions of bore 36 proximate an upper end thereof. Second bosses 34 are formed on the body of base plate 24 intermediate tabs 30. Each of second bosses 34 defines an axial bore 38 that preferably is circular in cross-sectional shape.

Figure 3:
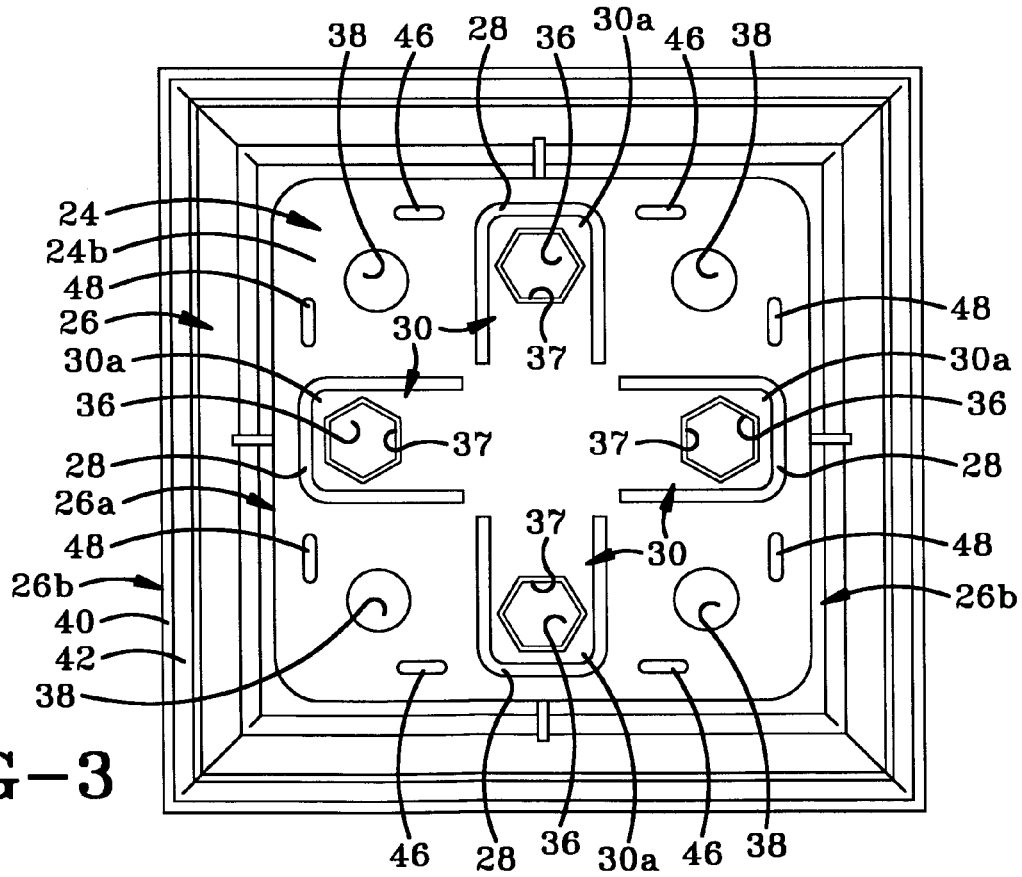
FIG. 3 is a bottom view of the mounting bracket of FIG. 2.
Figure 4:
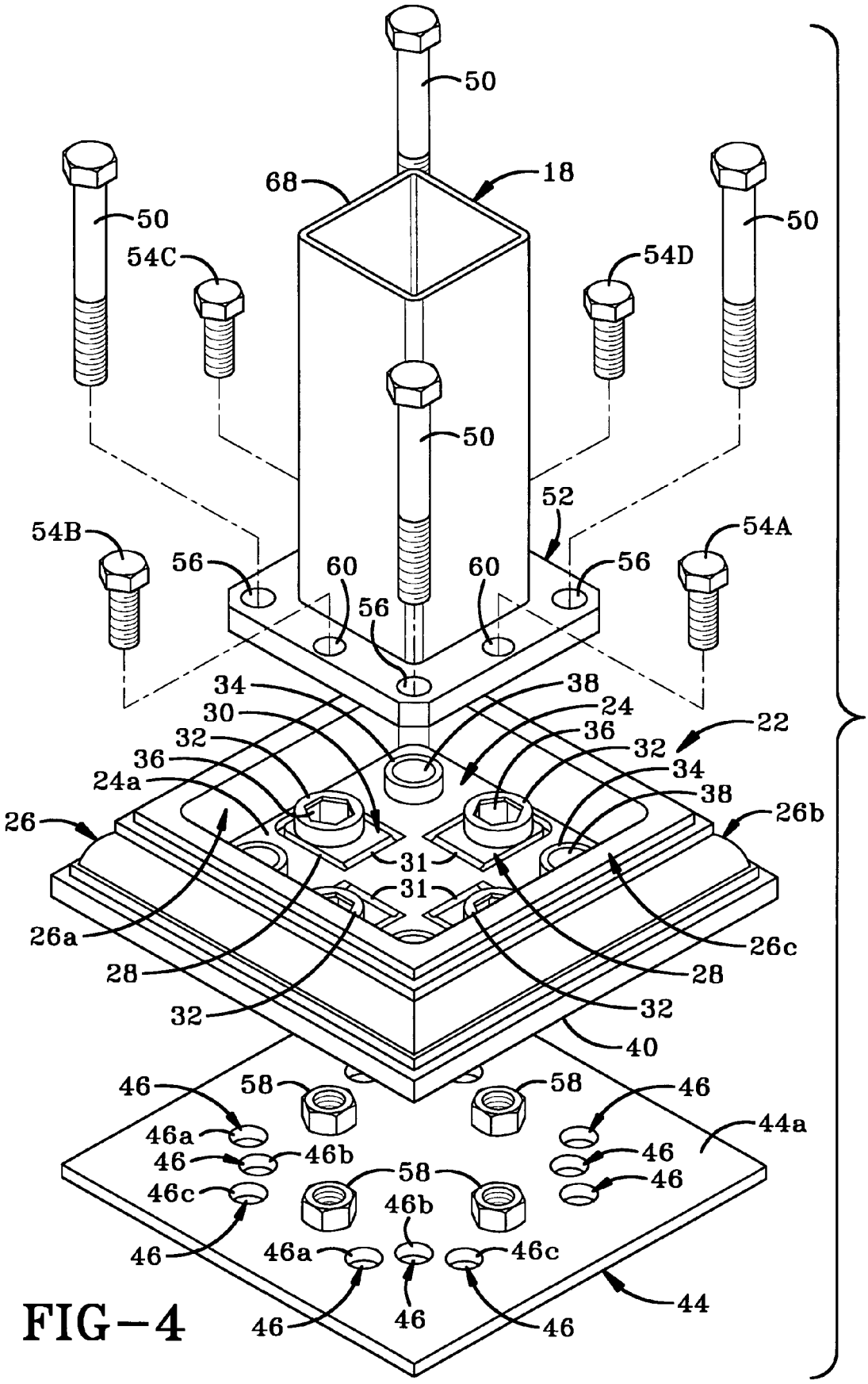
FIG. 4 is a partial exploded perspective view the mounting bracket connected to a metal support for a post.
Figure 5:
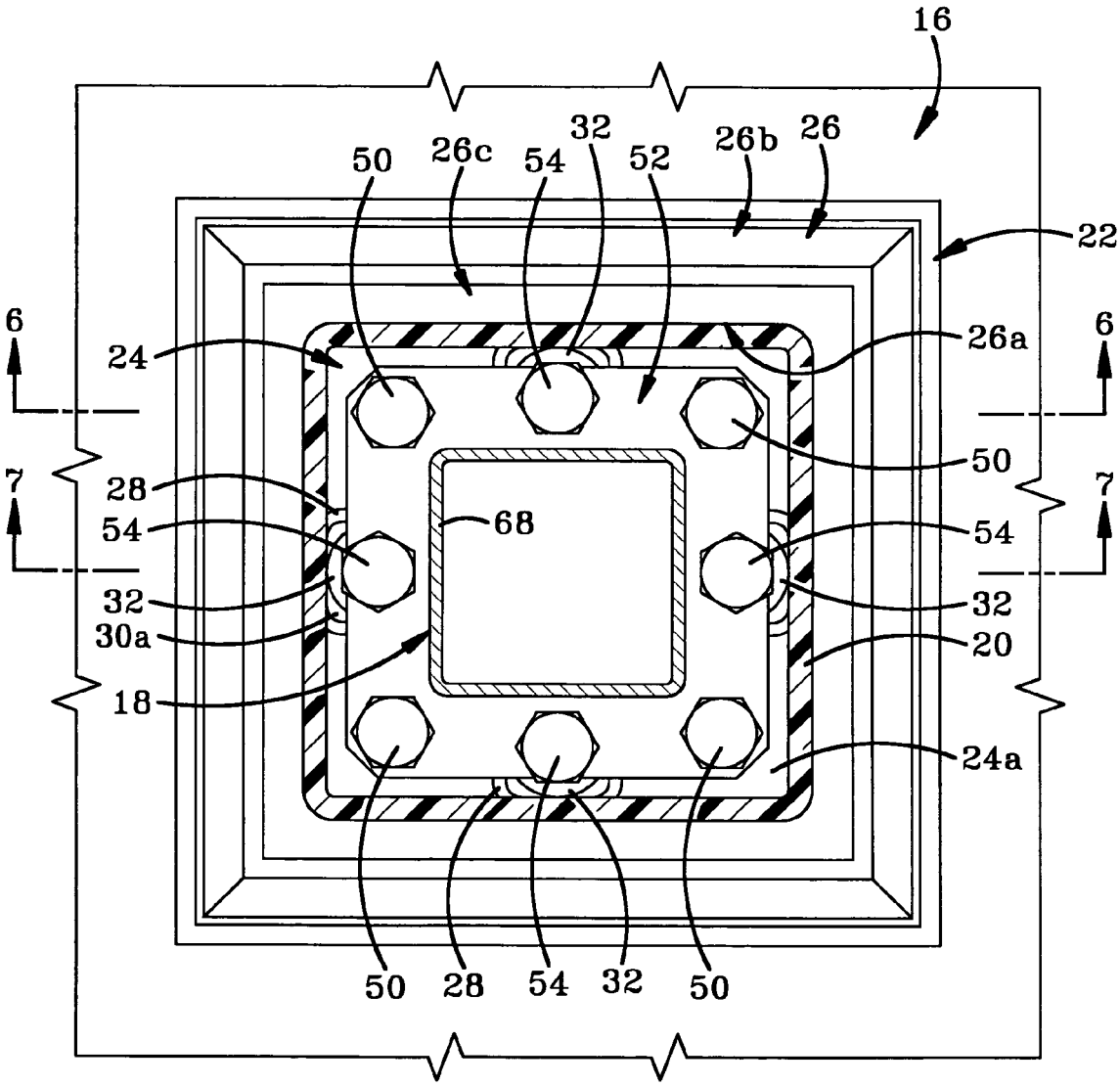
FIG. 5 is a top view of the mounting bracket and metal support through line 5-5 of FIG. 1.
Figure 6:
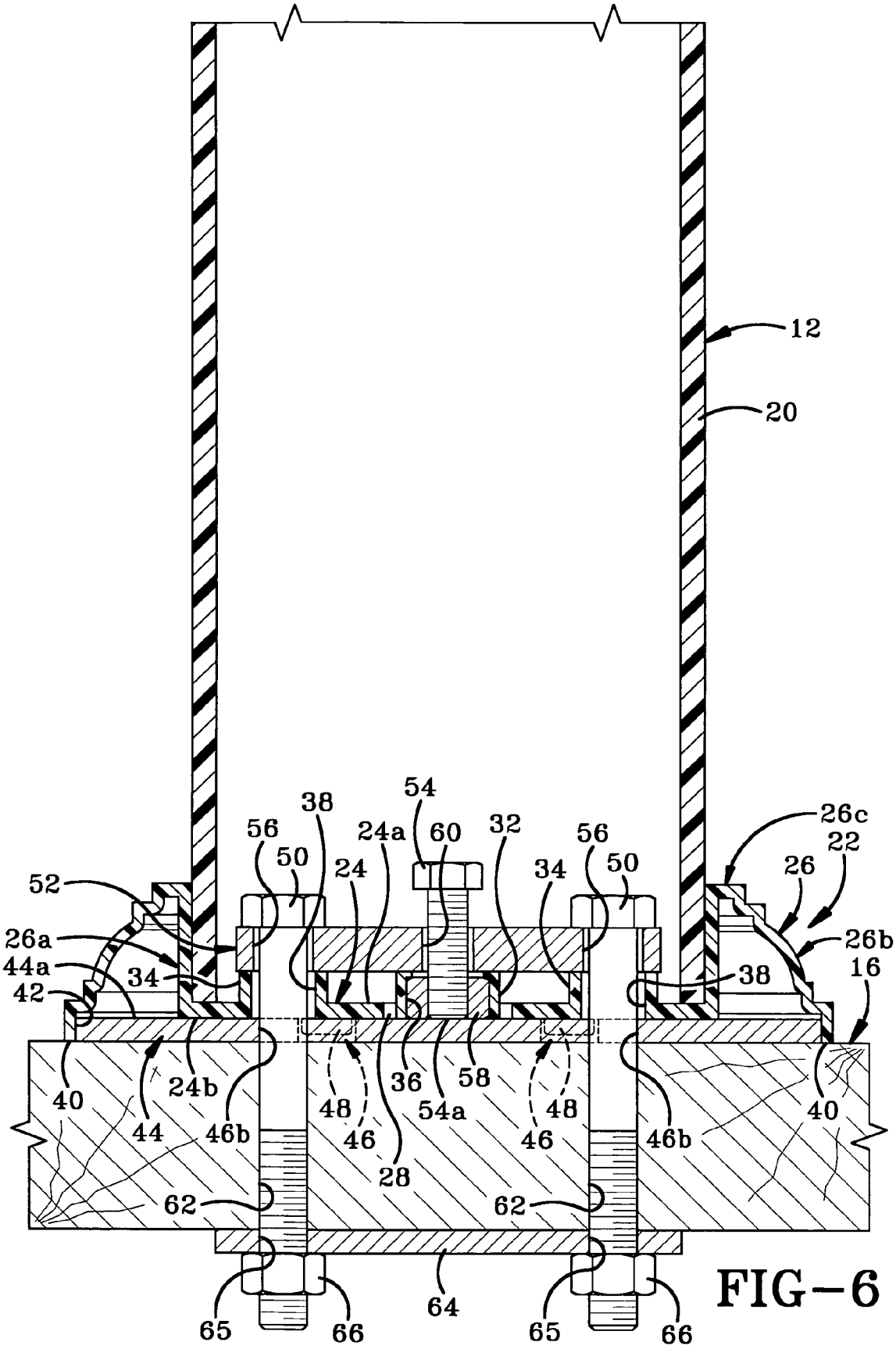
FIG. 6 is a side elevational view through line 6-6- of FIG. 5.

The underside of mounting bracket 22 is shown in FIG. 3. Peripheral wall 26 has a lowermost rim 40 adapted to rest on surface 16. Peripheral wall 26 further defines a peripheral recessed area 42 which is sized and shaped to be complementary to a bearing plate 44 (FIG. 4) which is receivable therein. When bearing plate 44 is received within recessed area 42 of mounting bracket 22, upper face 44*a* of bearing plate 44 abuts the lower face 24*b* of base plate 24. Bearing plate 44 preferably is manufactured from a metal so as to provide an adequate supporting surface for post 12 and a rigid surface against which adjustment bolts 54, may act. FIG. 4 shows that bearing plate 44 defines a plurality of apertures 46 therein, with the apertures 46 being arranged in sets of three. Lower face 24*b* of base plate 24 is provided with a plurality of positioning nubs 48 (FIG. 3). A nub 48 extends outwardly and downwardly from lower face 24*b* of base plate 24 and on each side of each bore 38. When bearing plate 44 abuts lower face 24*b* of base plate 24, the nubs 48 extend into the apertures 46*a* and 46*c* of each group of apertures 46 on bearing plate 44 (FIG. 4). Each aperture 46*b* is aligned with one of the bores 38 so that a fastener 50 can be inserted therethrough as will be hereinafter described.

Referring to FIGS. 4 & 6-8, mounting bracket 22 is used in the following manner. Metal support 18 and mounting bracket 22 are connected to surface 16 by inserting bolts 50 through apertures 56 (FIG. 6) in adjustment plate 52; then through aperture 38 in a second boss 34 on base plate 24, through aperture 46*b* in bearing plate 44 and then into an aperture 62 in surface 16. Preferably, a securing plate 64 (FIG. 6) is provided beneath surface 16 and bolts 50 pass through apertures 65 in plate 64 and are locked into position by means of nuts 66. In this position, adjustment plate 52 abuts base plate 24 which in turn abuts bearing plate 44. Shaft 68 of metal support 18 extends upwardly and outwardly away from base plate 24 and bearing plate 44 at an angle relative to the upper face 24*a* of base plate 24. Because the adjustment plate 52, base plate 24 and bearing plate 44 are all planar members, shaft 68 lies substantially at right angles to base plate 24 and bearing plate. However, just because shaft 68 lies substantially at right angles to base plate 24 does not mean that support 18 is vertically leveled. This can only be ascertained by using a bubble level or other leveling device held against the shaft 68 of the support 18.

Figure 7:
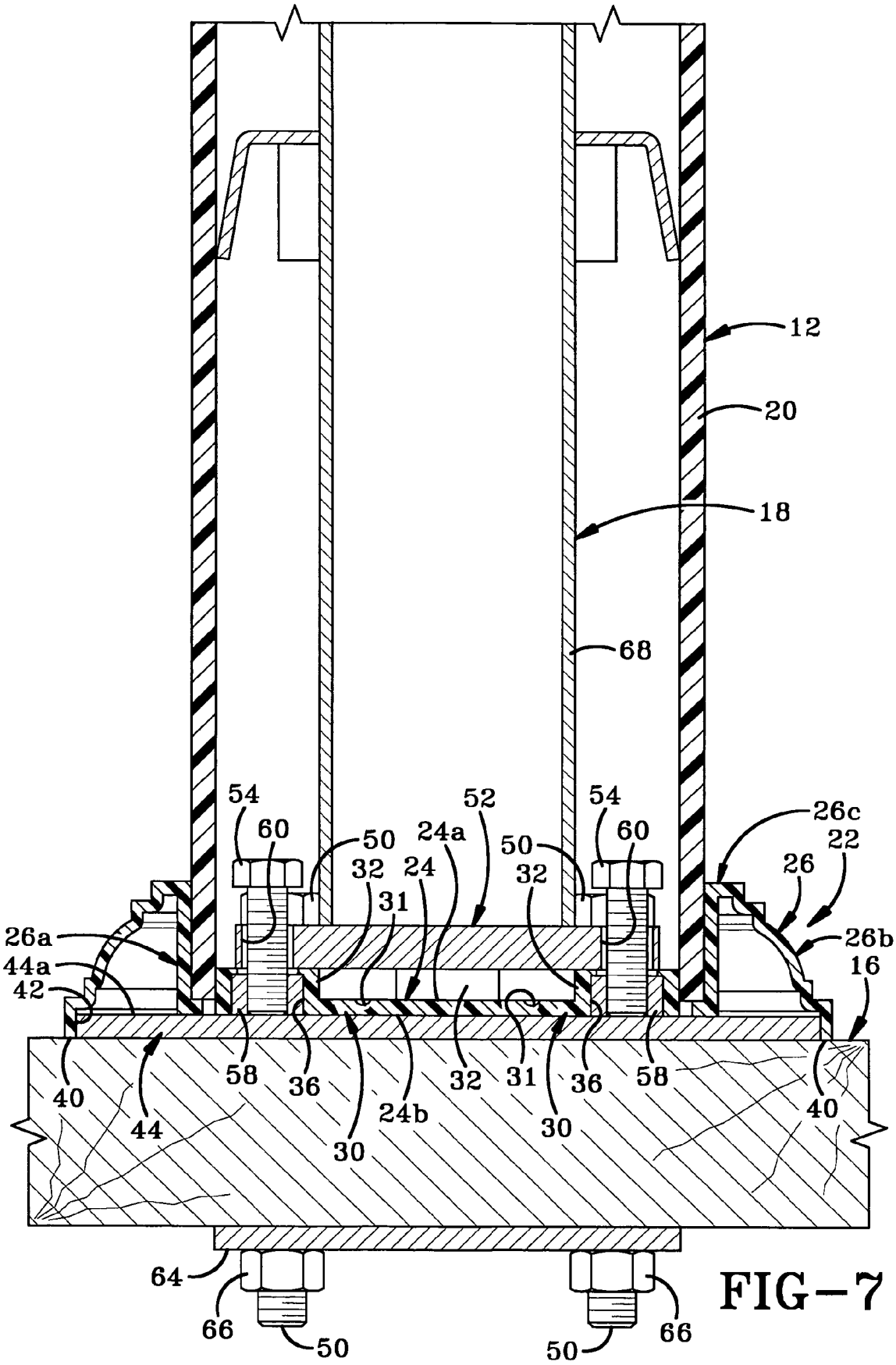
FIG. 7 is a side elevational view through line 7-7 of FIG. 5.
Figure 7A:
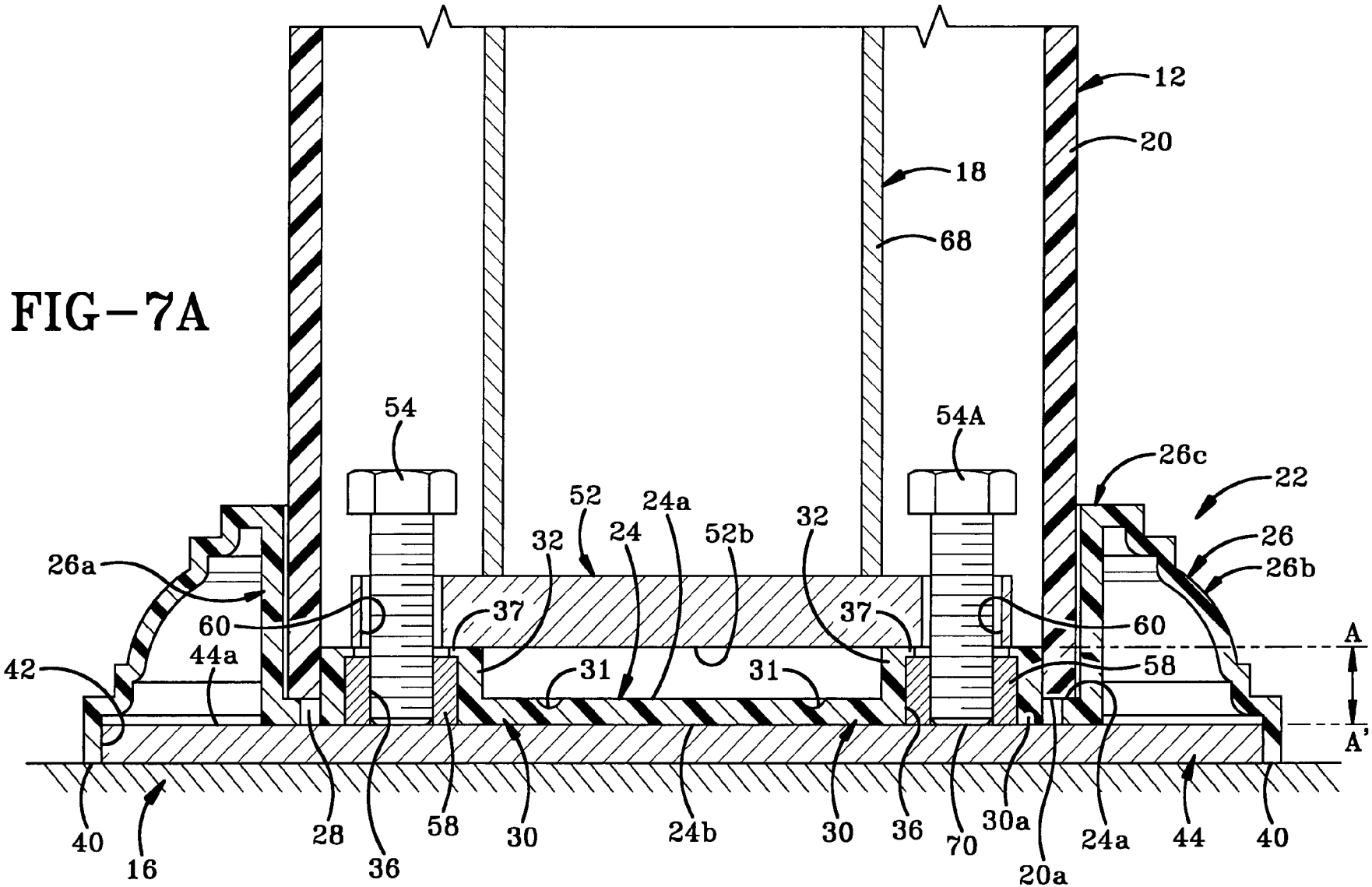
FIG. 7*a* is an enlargement of the mounting bracket, mounting plate and bottom end of the post shown in FIG. 7.

When bearing plate 44 is positioned on surface 16 and bolts 50 are inserted through the above-mentioned apertures, nuts 66 are initially only finger-tightened so as to hold the components together. Each adjustment bolt 54 is then inserted through an aperture 60 in adjustment plate 52 and is threadably received into a retention nut 58 contained within the aperture 36 in a first boss 32 of base plate 24. Retention nut 58 engages lip 37 and therefore cannot be withdrawn upwardly through bore 36. Bearing plate 44 does not include any apertures aligned with apertures 60 or 36. Consequently, as bolt 54 is threaded through nut 58, the end 54*a* of bolt 54 engages the upper face 44*a* of bearing plate 44. Once metal support 18, mounting bracket 22 and bearing plate 44 are lightly secured in place on surface 16, the installer uses a bubble level (not shown) or any other suitable leveling device to determine whether or not the shaft 68 of metal support 18 is plumb in a vertical direction, i.e., whether or not the shaft 68 is vertically level. FIG. 7*a* is an enlargement of that portion of FIG. 7 showing mounting bracket 22 and bearing plate 44 on surface 16. If the installer determines that shaft 68 of metal support is vertically level, then nuts 66 are securely tightened and the vinyl sleeve 20 is slipped over metal support 18. Sleeve 20 is moved downwardly until the end 20*a* thereof abuts the upper face 24*a* of base plate 24 in an area adjacent the inner wall 26*a*. The bottom of sleeve 20 is wedged between first bosses 32 and inner wall 26*a* of mounting bracket 22. Furthermore, the rim 40 of mounting bracket 22 lies in abutting contact with surface 16. Rails 14 may then be attached to post 12 and the weight of the rails 14 keeps the post 12 seated in mounting bracket 22.

If, however, the installer uses the bubble level and determines that shaft 68 of metal support 18 is not vertically level, the installer will select a relevant one of the adjustment bolts 54, such as bolt 54A (FIGS. 7&8), and will selectively rotate the same in a first direction. As bolt 54A rotates in the first direction, i.e., bolt 54A is screwed through nut 58, the bolt's end 70 engages and pushes against upper face 44*a* of bearing plate 44. As the bolt 54A continues to rotate in the first direction, a section of the shaft of bolt 54A begins to extend beneath nut 58. Nut 58 is prevented from being withdrawn from bore 36 by lip 37 and, consequently, any further rotation of bolt 54A, causes at least a portion of tab 30A to deflect upwardly out of alignment with the upper surface 24*a* of base plate 24 and out of contact with upper face 44*a* of bearing plate 44. The portion of tab 30 which deflects upwardly is the free end 30*a* thereof. Because the upper end 32*a* of first boss 32 is in contact with the bottom surface 52*b* of adjustment plate 52, as tab 30A and first boss 32A move upwardly and out of alignment with base plate 24, a portion of the adjustment plate 52 in contact with first boss 32A is raised away from the rest of base plate 24. The raised portion of adjustment plate 52 pivots through an angle α relative to its former position. This also causes the shaft 68 of metal support 18 to travel through an angle α relative to its former position. Consequently, the rotation of bolts 54 in a first direction causes a portion of the base plate 24 (i.e., tab 30A and associated boss 32A) to be urged upwardly and out of alignment with the rest of base plate 24 and upwardly and outwardly away from abutting contact with bearing plate 44. The pivoting movement of tab 30A and first boss 32A causes a portion of adjustment plate 52 of metal support 18 to be moved upwardly, thereby causing shaft 68 of metal support 18 to move through an angle α relative to its previous position as is shown in phantom on FIG. 8. Inasmuch as the rest of base plate 24 and all of the bearing plate 44 are in exactly the same position before and after the rotation of bolt 54, the change in orientation of shaft 68 can be measured relative to one of base plate 24 and bearing plate 44. Prior to adjustment, shaft 68 lies substantially at right angles to bearing plate 44. This is because adjustment plate 52, base plate 24 and bearing plate all present planar surfaces to each other and shaft 68 lies perpendicular to adjustment plate 52. After adjustment by the installer, shaft 68 lies at the same angle relative to adjustment plate 52, but the position of adjustment plate 52 has moved through an angle of an angle of a degrees. Consequently, shaft 68 lies at an angle of (90+α) degrees relative to bearing plate 44.

After the initial adjustment using bolt 54A, the installer again holds a bubble level against shaft 68 to determine whether the adjustment of bolt 54A has brought shaft 68 into a vertically leveled position. If not, the installer may adjust bolt 54A further, by continuing to rotate bolt 54A in the same direction as before, or by partially rotating bolt 54A in a second and opposite direction. As bolt 54A is rotated in the second direction, tab 30A and its associated first boss 32A are moved downwardly back toward the rest of base plate 24. Tab 30A may be moved downwardly back into its original position and into alignment with the upper surface 24*a* of base plate 24. The installer may also select one or more of the other bolts 54 (namely one or more of bolts 54B, 54C and 54D-FIG. 4) and rotate them in one or more of the first and second direction to adjust them in a similar manner. The installer continues to make adjustments to the bolts 54A, 54B, 54C and 54D until the bubble level held against the sides of shaft 68 indicates that the shaft 68 is vertically level. Nuts 66 are then securely tightened and vinyl sleeve 20 is slipped over metal support 18.

Figure 8:
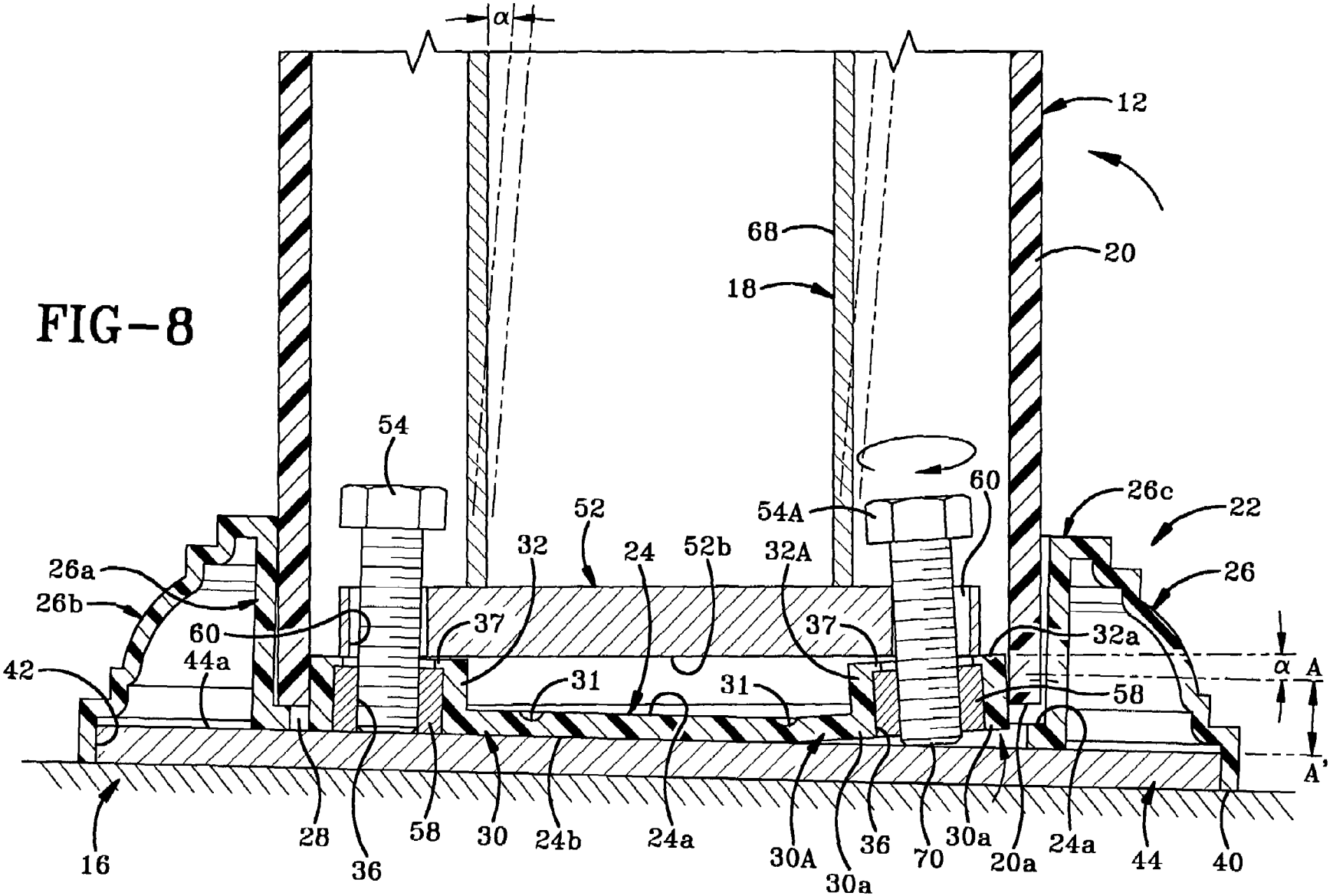
FIG. 8 is a side elevational view of a post seated in the mounting bracket and showing one of the leveling members adjusted to vertically level the metal support and post.
Figure 9:
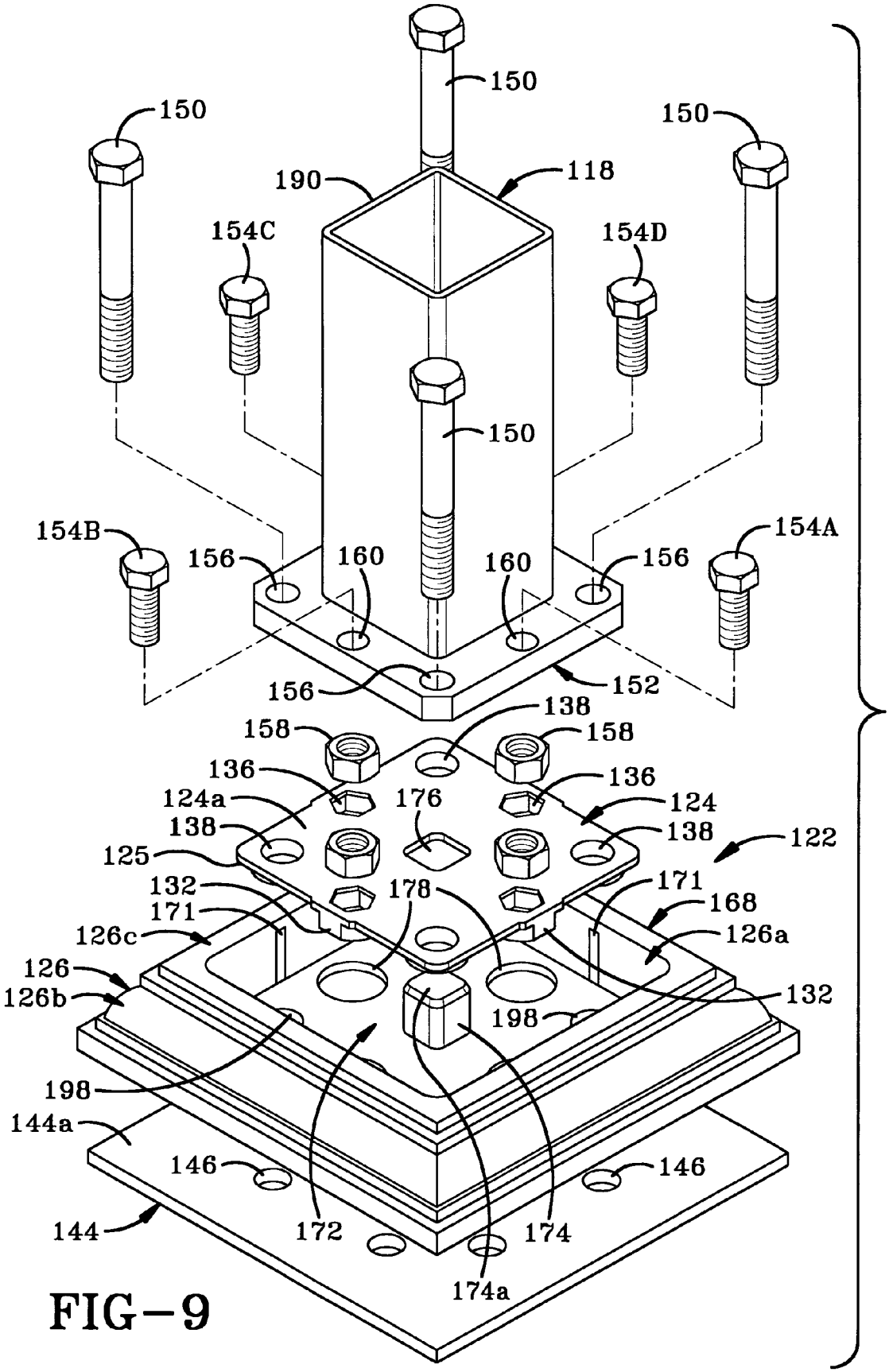
FIG. 9 is an exploded perspective view of a second embodiment of a mounting bracket in accordance with the present invention.
Figure 10:
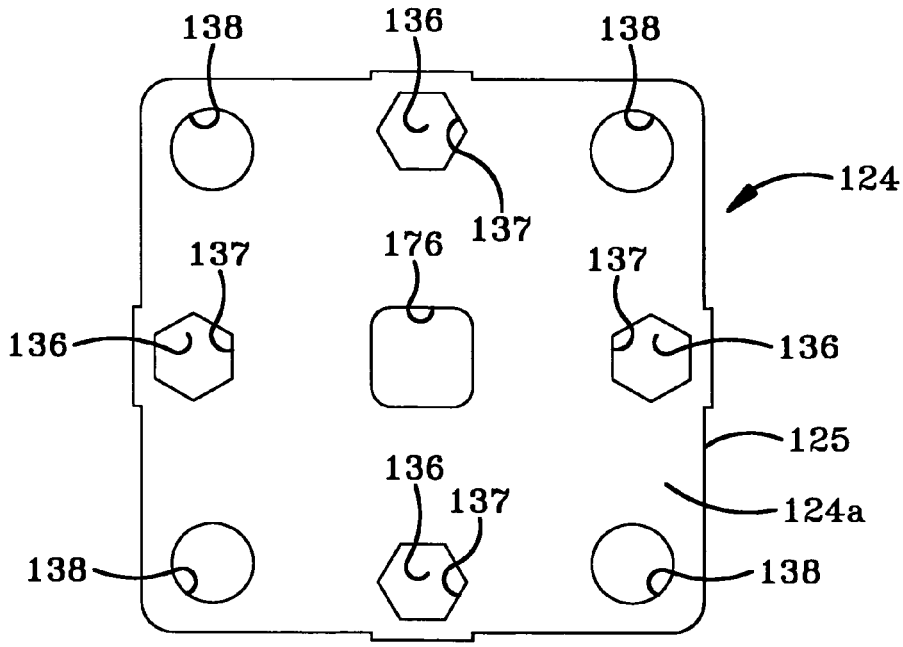
FIG. 10 is a top view of the mounting bracket of FIG. 9.
Figure 11:
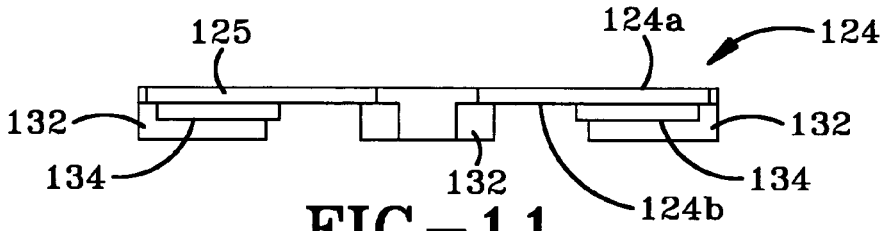
FIG. 11 is a side view of the mounting bracket of FIG. 9.
Figure 12:
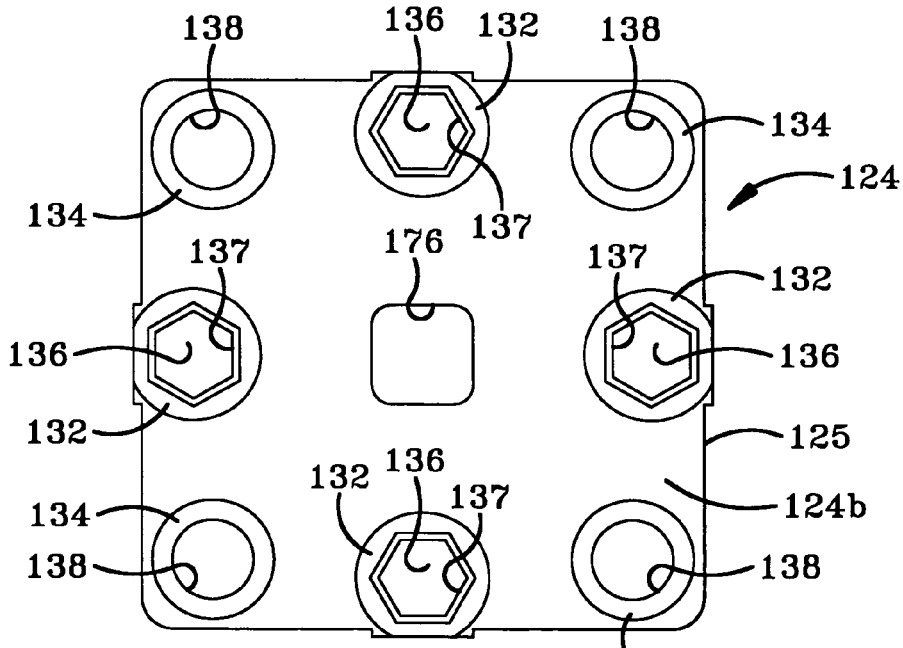
FIG. 12 is a bottom view of the mounting bracket of FIG. 9.
Figure 13:
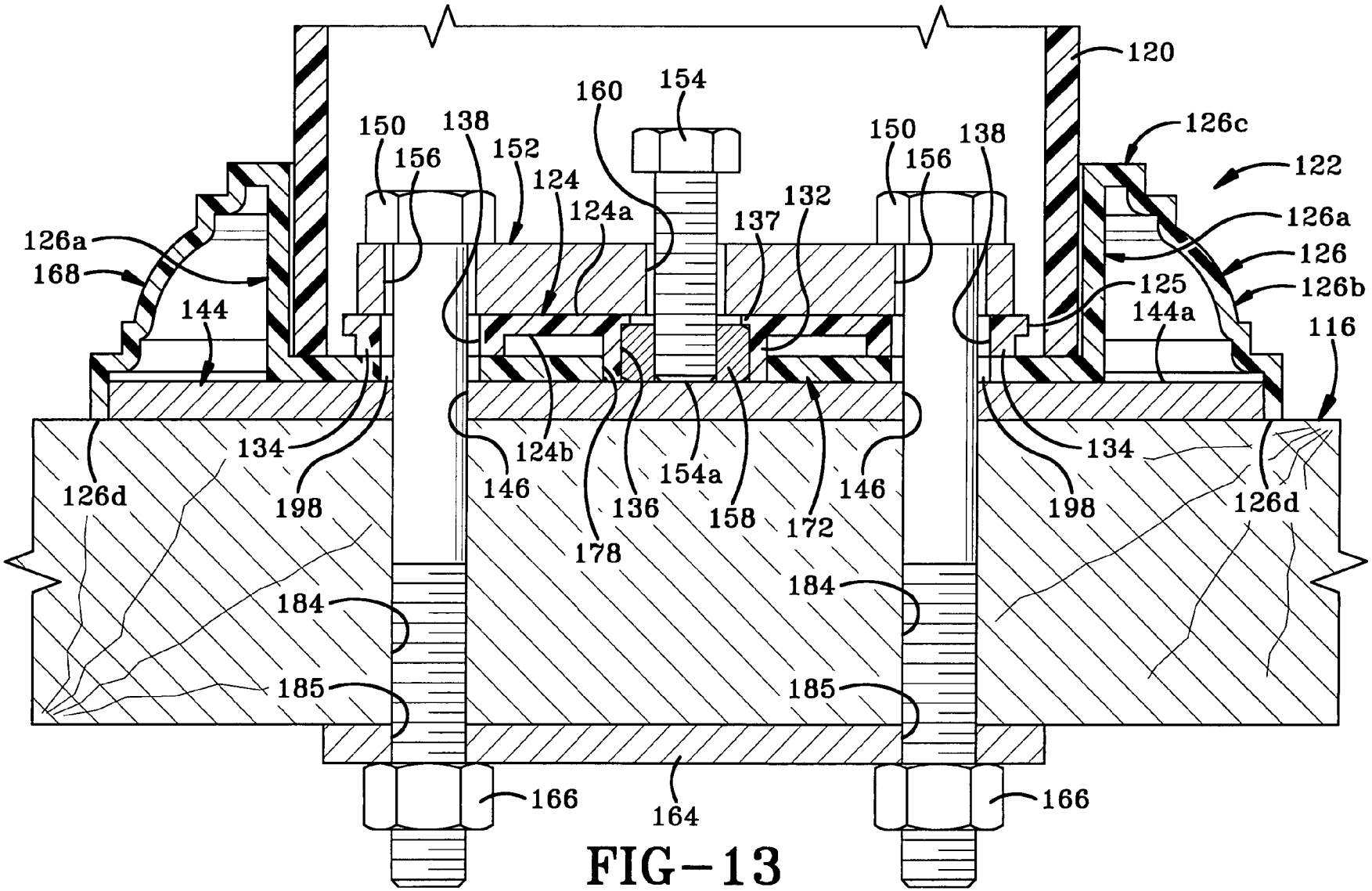
FIG. 13 is a partial cross-sectional side view of the mounting bracket of FIG. 9 in use with a vinyl sleeve, with the view taken along a line passing directly through one side of the adjustment plate of the metal support bottom.
Figure 14:
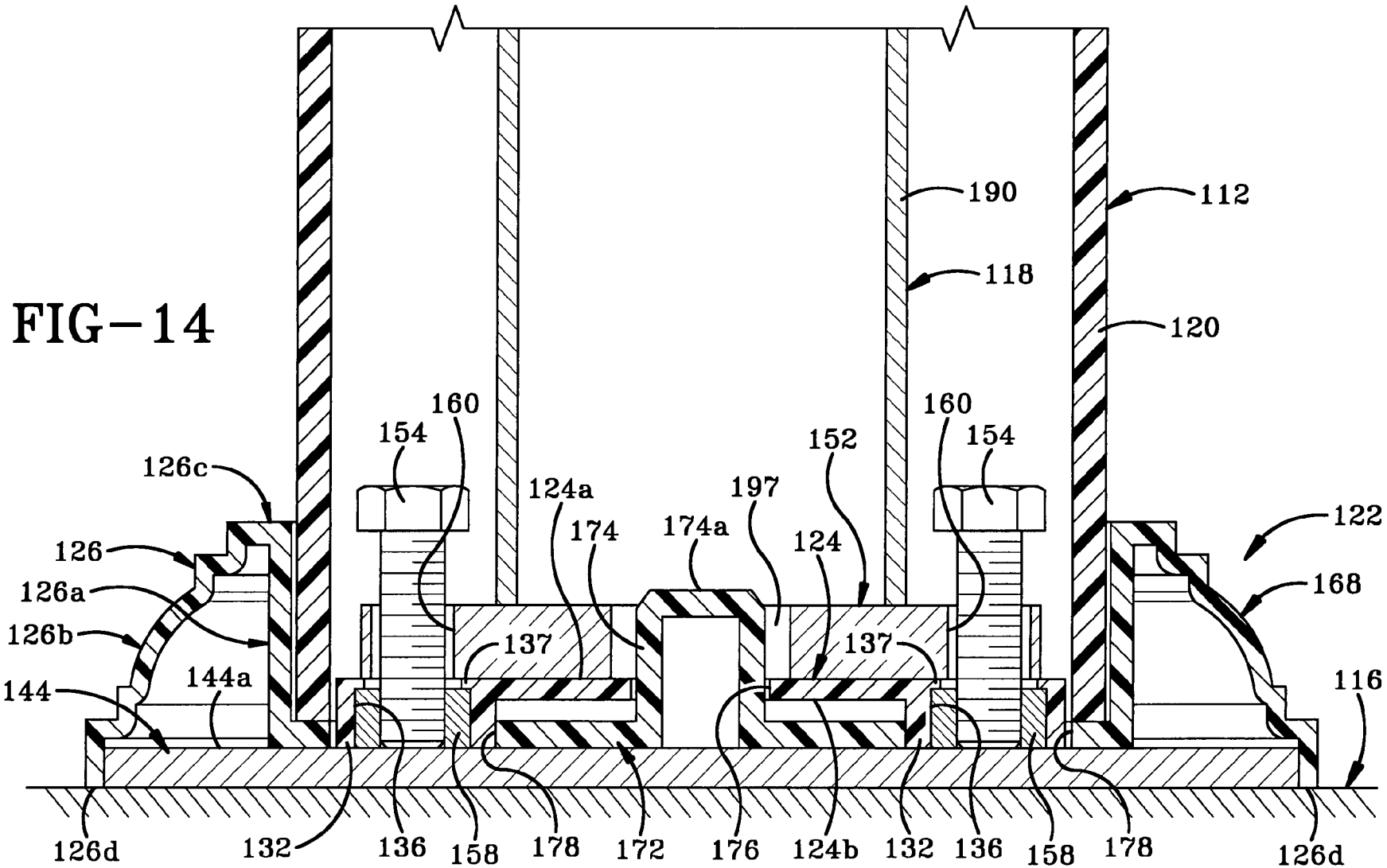
FIG. 14 is a partial cross-sectional side view of the mounting bracket taken along a line passing through the center of the bracket.
Figure 15:
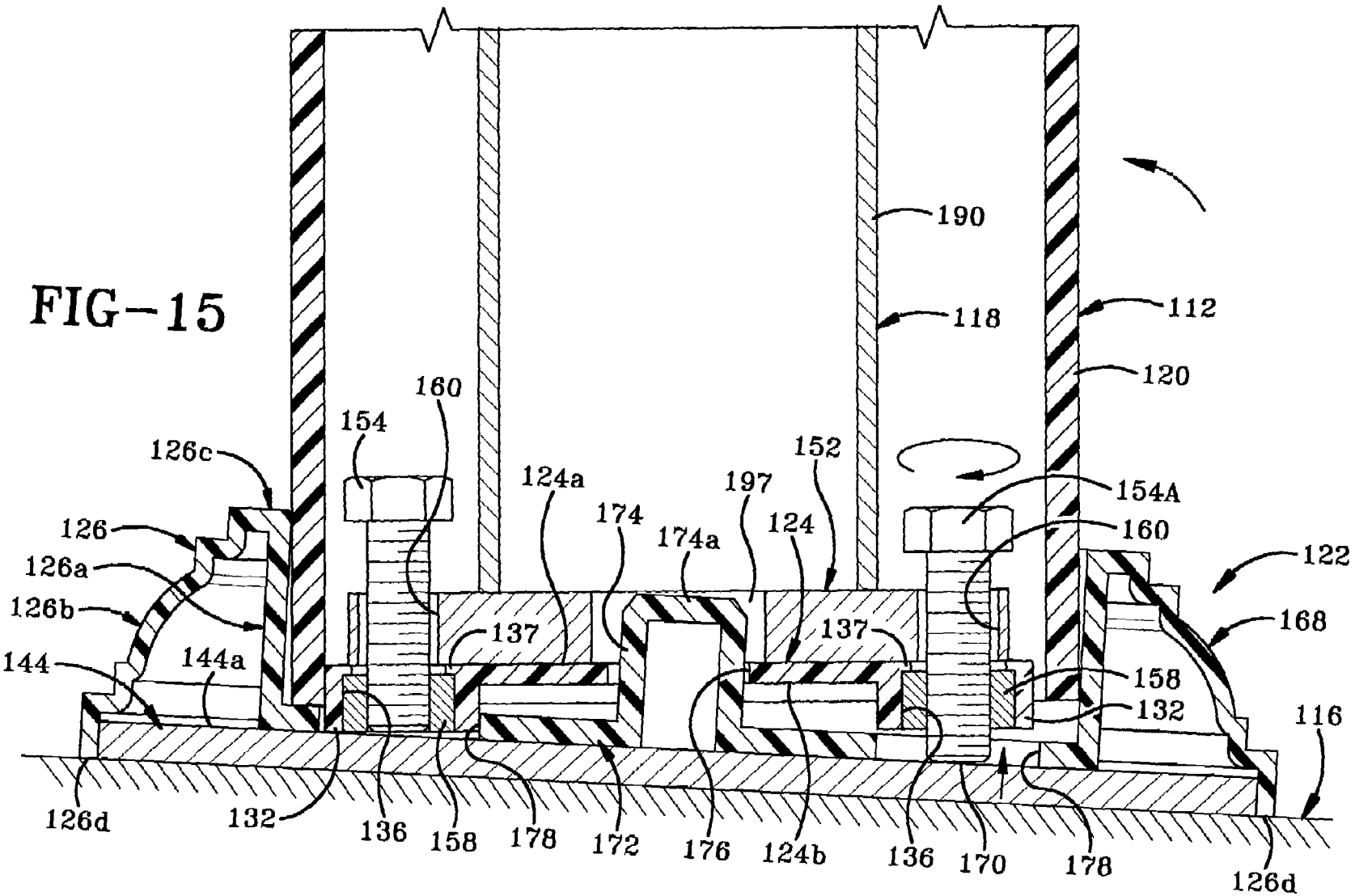
FIG. 15 is a partial cross-sectional side view of the mounting bracket of FIG. 14 being adjusted to vertically level the railing post.

As may be seen from FIGS. 8, the bottom end 20*a* of vinyl sleeve 20 may no longer contact upper face 24*a* of base plate 24. The bottom end 20*a* of sleeve 20 does tends to be wedged between first bosses 32 and inner walls 26*a* of mounting bracket 22. Once sleeve 20 is applied over support 18, rails 14 may be attached thereto to finish construction of the deck railing 10.

It should be noted that because adjustment bolts 54 which engage first bosses 32 are provided on flexible tabs 30, the position of metal support 18 can be adjusted without changing the position or orientation of base plate 24 relative to surface 16. Consequently mounting bracket 22 remains substantially stationary and in abutting contact with surface 16 even while the angular orientation of metal support 18 is adjusted. It should be noted that the non-tab portion of base plate 24, i.e., that portion surrounding tab 30, does not move as the bolts 54 are rotated in either of the first and second directions. Furthermore, when mounting bracket 22 forms the floor of a mounting bracket, the trim portion and non-tab portion of the floor of the mounting bracket remains stationary when the adjustment bolts 54 are rotated in one of the first and second directions. This gives mounting bracket 22 and post 12 a more finished and aesthetically pleasing appearance.

It will be understood that while the adjustment mechanism has been herein described as a bolt 54 and cooperating nut 58, any other suitable leveling mechanism or member can be utilized for the purpose of urging the tabs 30 on base plate 24 away from bearing plate 44 and to thereby change the vertical orientation of shaft 68.

It will also be understood that bearing plate 44 can be omitted, especially if the post is to be installed on a substantially solid surface such as concrete.

While base plate 24 has been shown and described as an integral part of mounting bracket 22, i.e., forming the floor of a recessed area within mounting bracket 22, it should be understood that the base plate 24, with tabs 30 formed therein, may alternatively be provided as an insert that is received on top of the floor portion of a mounting bracket, i.e., such as one of the mounting brackets disclosed in U.S. Pat. Nos. 6,141,928 or 6,718,710. In these instances, the base plate insert would lay intermediate the adjustment plate 52 on the support 18 and the floor of the mounting bracket. The adjustment bolts would extend through the adjustment plate, through the base plate insert, through the floor of the mounting bracket and into contact with the bearing plate.

Referring to FIGS. 9-15, there is shown a second embodiment of mounting bracket in accordance with the present invention and generally indicated at 122. Mounting bracket 122 is adapted to secure a post 118 to a surface 116. Post 118 is again of a type that preferably includes a central support 190 having an adjustment plate 152 integrally formed therewith. Adjustment plate 152 includes a plurality of spaced apart apertures 160 through which bolts 150 are inserted to secure post 118 to surface 116. Adjustment plate also includes a plurality of spaced apart second apertures 160. A mounting bracket 122, which includes a base plate insert 124 and a trim assembly 168, is used to vertically level post 118 in a manner that is aesthetically appealing. Mounting bracket 122 and base plate 124 preferably are used in conjunction with a bearing plate 144 and securement plate 164 (FIG. 13) to securely mount post 118 to surface 116.

Trim assembly 168 includes a peripheral wall 126 surrounding a recessed area 170, which area 170 includes a floor 172. Peripheral wall 126 comprises a substantially vertical inner wall 126*a*, which extends upwardly and outwardly away from floor 172 and a decoratively profiled outer wall 126*b* connected to inner wall 126*a* by an upper ledge 126*c*. A plurality of spacers 171 may be provided at intervals along vertical wall 126*a*. A central hub 174 extends upwardly and outwardly away from floor 172. Hub 174 is generally square in cross-section and may be solid or hollow and preferably has a beveled upper end 174*a*. As may be seen from FIG. 14, upper end 174*a* of post lies inwardly relative to upper ledge 126*c* of peripheral wall 126. Floor 172 further defines a plurality of alternating first apertures 178 and second apertures 198. First and second apertures 178, 198 are spaced in a pattern around hub 174. Floor 172 is recessed relative to the surface-engaging lower edge 126*d* (FIG. 14) of peripheral wall 126. This provides a second recessed area into which bearing plate 144 is received. Preferably bearing plate 144 and the second recessed area have substantially the same length and width to ensure a tight fit between trim assembly 168 and bearing plate 144.

Base plate 124 is sized and shaped to be received within the recessed area 170 of trim assembly 168 and to abut the floor 172 thereof. Base plate 124 is smaller in width and length than the recessed area 170 and, consequently, peripheral outer edge 125 of base plate 124 lies a spaced distance inwardly of vertical wall 126*a* FIG. 13) when base plate 124 is received within area 170. This allows sleeve 126 to be received between outer edge 124*a* and vertical wall 126*a*.

Base plate 124 is shown in greater detail in FIGS. 9-12. It can be seen from these figures that upper face 124*a* of base plate 124 is substantially flat while lower face 124*b* includes a plurality of first and second bosses 132, 134 extending outwardly away therefrom. First and second bosses 132, 134 preferably are integrally formed with base plate 124. First bosses 132 extend further outwardly away from lower face 124*b* of base plate 124 than do second bosses 134. Each of the first and second bosses 132, 134 defines an axial bore therethrough and these axial bores, being 136 and 138 respectively, extend through to upper face 124*a*. Bores 136 are substantially hexagonal in shape and bores 138 are substantially circular in shape. A lip 137 extends partially into each bore 136 thereby narrowing the bore's dimensions proximate the upper surface 124*a* of base plate 124. A central aperture 176 extends through base plate 124 and is complementary sized and shaped to receive hub 174 of trim assembly 168 therethrough. A hexagonal retention nut 158 is received within each of bores 136 of first bosses 132. Retention nut 158 abuts lip 137 and consequently cannot be withdrawn from base plate 124 through the upper surface 124*a* thereof.

In use, base plate 124 is inserted into recessed area 170 of trim assembly 168 causing hub 174 extending outwardly from floor 172 to be received through central aperture 176 in base plate 124 and an aligned hole 197 (FIG. 15) in adjustment plate. First bosses 132 extend downwardly through apertures 178 in floor 172 and second bosses 134 act as spacers between lower face 124*b* of base plate 124 and floor 172. The bores 138 of second bosses 134 align with apertures 198 in floor 172. If a bearing plate 144 is being utilized, then bearing plate 144 is inserted into the second recessed area of trim assembly 168. One of apertures 146 of each of the groupings of apertures in bearing plate 144 is aligned with one of the pairs of aligned bores 138 and apertures 198. A portion of the solid top surface 144*a* of bearing plate 144 lies beneath each pair of aligned bores 136 and apertures 178. Adjustment plate 152 is then inserted into recessed area 170 of trim assembly 168 so that a bottom surface of plate 152 abuts the upper surface 124*a* of base plate 124. When adjustment plate 152 is so positioned, apertures 156 in adjustment plate 152 align with apertures 138, 198 and 146 of base plate 124, floor 172 and bearing plate 144 respectively. Bolts 150 are inserted through the aligned set of apertures beginning with apertures 138 and through pre-drilled holes 184 in the surface 116, through apertures 185 in securement plate 164 and are loosely retained in place by a nut 166. Each adjustment bolt 154 is inserted through an aligned aperture 160 in adjustment plate 152 and bore of a retaining nut 158 in base plate 124. In this position, bottom end 154*a* of each bolt 154 engages a substantially solid portion of the upper surface 144*a* of bearing plate 144. Once bolts 150 and 154 are in position, the installer uses a bubble level or any other suitable device to check whether or not the shaft 190 of support 118 is vertically plumb. Once support 118 is vertically leveled, then bolts 150 are securely tightened, vinyl sleeve 120 is slipped over metal support 118 and rails (not shown) are then attached to post 112. If, however, it is found that shaft 190 of support 118 is not vertically leveled, then the installer selects one of the bolts 154, such as bolt 154A (FIG. 15) and rotates the same in a first direction so that a portion of bolt 154 extends below the bottom 158*a* of nut 158. As the portion of bolt 154A extending below bottom 158*a* increases in length, the top 158*b* of nut engages lip 137 and, because it cannot rotate out of base plate 124, nut 158 lifts base plate 124 upwardly away from floor 172. This changes the vertical orientation of shaft 190 of metal support 118. The installer then checks with a bubble level whether or not this adjustment of bolt 154A has vertically leveled the metal support 118. If the installer finds he has rotated bolt 154A too far in a first direction, he can simply rotate bolt 154A a slight amount in a second and opposite direction to decrease the length of bolt extending beneath the bottom 158*a* of nut 158 and consequently changing the angle of base plate 124 relative to floor 172. The installer may adjust one or more of bolts 154A, 154B, 154C and 154D (FIG. 9) by rotating them in the first and/or second direction until support 118 is vertically leveled.

It should be noted again that the adjustment of bolts 154 causes movement in metal support 118 without causing substantial movement of the trim portion 168. Trim assembly therefore stays substantially in contact with surface 116 and thereby gives the resulting railing a finished and aesthetically pleasing appearance.

It will be understood by those skilled in the art that the trim assembly 168 can be omitted in the instance where a trim profile (not shown) will be independently applied once the post is installed. In this instance, vertical leveling of the shaft of the metal support can be facilitated by providing the base plate 124 and the bearing plate 144. Once the shaft has been vertically leveled, a vinyl sleeve can be slipped over the metal support and trim assemblies can be separately glued or otherwise affixed to the bottom end of the vinyl sleeve to provide a more aesthetically pleasing finish to the post.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the invention is an example and the invention is not limited to the exact details shown or described.

The invention claimed is:

1. A mounting bracket for mounting and vertically leveling a post on a planar surface; wherein the post includes a shaft extending perpendicularly upwardly and outwardly away from an upper surface of an adjustment plate; and wherein the mounting bracket comprises:

a trim assembly including a peripheral wall and a movable portion; wherein the trim assembly includes a recessed area having a floor and the adjustment plate is adapted to be received within the recessed area; and wherein the peripheral wall comprises an inner wall extending upwardly and outwardly away from the floor and an outer wall having a decorative profile formed therein, and the movable portion is disposed inwardly of said peripheral wall and comprises a base plate receivable within the recessed area, said base plate having a lower face disposed adjacent the floor and an upper face adapted to be disposed adjacent a lower surface of the adjustment plate; and an adjustment device selectively engageable with the movable portion of the trim assembly to cause the movable portion to move relative to the peripheral wall, thereby causing a change in the orientation of the adjustment plate.

2. The mounting bracket as defined in claim 1, wherein the base plate defines a first aperture therein and the adjustment device comprises a bolt receivable through the first aperture; and wherein the bolt is rotatable in a first direction to deflect a part of the base plate away from the floor; and is rotatable in a second direction to cause the part of the base plate to move back toward the floor of the trim assembly.

3. The mounting bracket as defined in claim 2, wherein the base plate further includes a retaining nut disposed within the first aperture; said nut being threadably engageable with the bolt.

4. The mounting bracket as defined in claim 2, further comprising a first boss extending outwardly away from one of the upper and lower faces of the base plate; and wherein the first boss defines a bore therein and said bore constitutes the first aperture in the base plate.

5. The mounting bracket as defined in claim 1, wherein the base plate defines a plurality of first bosses extending outwardly away therefrom; each of the first bosses defining a bore therein that constitutes a first aperture and each first aperture having a nut threadably engaged therein; and wherein the mounting bracket further includes a plurality of adjustment devices, each adjustment device being a bolt which is received within the first aperture of one of the first bosses; and wherein one or more of the adjustment devices is selectively and individually engageable to move the base plate relative to the peripheral wall and to thereby change the orientation of the adjustment plate.

6. The mounting bracket as defined in claim 1, further comprising a bearing plate adapted to be disposed between the planar surface and the trim assembly; and wherein said adjustment device engages the bearing plate to move the movable member.

7. The mounting bracket as defined in claim 6, wherein the trim assembly has an underside and said underside includes a peripheral lip; and wherein the bearing plate is disposed within the peripheral lip of the trim assembly.

8. The mounting bracket as defined in claim 1, further comprising at least one fastener adapted to secure the trim assembly to the adjustment plate and to the planar surface.

9. The mounting bracket as defined in claim 1, wherein the base plate includes at least one flexible tab, the flexible tab being defined by a U-shaped slot extending through the base plate; and wherein the tab is substantially U-shaped and is integrally connected to a non-tab portion of the base plate along a first side.

10. The mounting bracket as defined in claim 9, wherein the tab defines a first aperture therein and the adjustment device comprises a bolt receivable through the first aperture; and wherein the bolt is rotatable in one of a first direction and a second direction to deflect a portion of the tab in one of out of alignment and into alignment with the non-tab portion of the base plate along a first side; and to thereby cause a change in the orientation of the adjustment plate.

11. The mounting bracket as defined in claim 10, wherein the trim assembly further includes a retaining nut disposed within the first aperture; said nut being threadably engageable with the adjustment bolt.

12. The mounting bracket as defined in claim 10, wherein the trim assembly comprises four substantially U-shaped tabs defined in the base plate; said tabs being disposed in a cross-like formation; and wherein each of the tabs includes a first boss; and said mounting bracket further includes four adjustment bolts, each bolt engaging in a retaining nut in a first boss on one of the tabs; whereby one or more of the adjustment bolts are selectively and individually engageable to cause at least a portion of the associated tab to move one of out of alignment and into alignment with the base plate and to thereby cause a change in the orientation of the adjustment plate.

13. The mounting bracket as defined in claim 12, wherein the first side of each one of the tabs defines a groove therein, and wherein said grooves form a line of weakness along which the tab is deflectable out of alignment with the base plate.

14. The mounting bracket as defined in claim 13, wherein each tab has a free end disposed opposite the respective groove, and wherein the first aperture in the tab is disposed proximate the free end thereof.

15. The mounting bracket as defined in claim 1, wherein the trim assembly further includes a base plate receivable within the recessed area of the trim assembly, said base plate having a lower face disposed adjacent the floor of the trim assembly and an upper face adapted to be disposed adjacent a lower surface of the adjustment plate; and wherein the movable portion of the trim assembly comprises at least one flexible tab, the flexible tab being defined by a U-shaped slot extending through the base plate; and wherein the tab is substantially U-shaped and is integrally connected to a non-tab portion of the base assembly along a first side.

16. The mounting bracket as defined in claim 15, wherein the base plate defines a first aperture therein and the adjustment device comprises a bolt receivable through the first aperture; and wherein the bolt is rotatable in a first direction to deflect a part of the base plate away from the floor; and is rotatable in a second direction to cause the part of the base plate to move back toward the floor of the trim assembly.

17. The mounting bracket as defined in claim 16, wherein the base plate further includes a retaining nut disposed within the first aperture; said nut being threadably engageable with the bolt.

18. The mounting bracket as defined in claim 16, further comprising a first boss extending outwardly away from one of the upper and lower faces of the base plate; and wherein the first boss defines a bore therein and said bore constitutes the first aperture in the base plate.

19. The mounting bracket as defined in claim 15, wherein the base plate defines a plurality of first bosses extending outwardly away therefrom; each of the first bosses defining a bore therein that constitutes a first aperture and each first aperture having a nut threadably engaged therein; and wherein the mounting bracket further includes a plurality of adjustment devices, each adjustment device being a bolt which is received within the first aperture of one of the first bosses; and wherein one or more of the adjustment devices is selectively and individually engageable to move the base plate relative to the peripheral wall and to thereby chage the orientation of the adjustment plate.

20. The mounting bracket as defined in claim 15, further comprising a bearing plate adapted to be disposed between the planar surface and the trim assembly; and wherein said adjustment device engages the bearing plate to move the movable member.

21. The mounting bracket as defined in claim 20, wherein the trim assembly has an underside and said underside includes a peripheral lip; and wherein the bearing plate is disposed within the peripheral lip of the trim assembly.

22. The mounting bracket as defined in claim 15, further comprising at least one fastener adapted to secure the trim assembly to the adjustment plate and to the planar surface.

23. The mounting bracket as defined in claim 15, wherein, said base plate includes at least one flexible tab, the flexible tab being defined by a U-shaped slot extending through the base plate; and wherein the tab is substantially U-shaped and is integrally connected to a non-tab portion of the base assembly along a first side.

24. The mounting bracket as defined in claim 23, wherein the tab defines a first aperture therein and the adjustment device comprises a bolt receivable through the first aperture; and wherein the bolt is rotatable in one of a first direction and a second direction to deflect a portion of the tab in one of out of alignment and into alignment with the non-tab portion of the base plate along the first side; and to thereby cause a change in the orientation of the adjustment plate.

25. The mounting bracket as defined in claim 23, wherein the base plate includes four substantially U-shaped tabs defined therein; said tabs being disposed in a cross-like formation; and wherein each of the tabs includes a first boss; and said mounting bracket further includes four adjustments bolts, each bolt engaging in a retaining nut in a first boss on one of the tabs; whereby one or more of the adjustment bolts are selectively and individually engageable to cause at least a portion of the associated tab to move one of out of alignment and into alignment with the upper surface of the base plate and to thereby cause a change in the orientation of the adjustment plate while the non-tab portion of the base plate remains substantially stationary.

26. The mounting bracket as defined in claim 25, wherein the first side of each one of the tabs defines a groove therein, and wherein said grooves form a line of weakness along which the tab is deflectable out of alignment with the base plate.

27. The mounting bracket as defined in claim 26, wherein each tab has a free end disposed opposite the respective groove, and wherein the first aperture in the tab is disposed proximate the free end thereof.

* * * * *

UNITED STATES PATENT AND TRADEMARK OFFICE

CERTIFICATE OF CORRECTION

PATENT NO. : 7,533,506 B2
APPLICATION NO. : 11/330008
DATED : May 19, 2009
INVENTOR(S) : Platt It is certified that error appears in the above-identified patent and that said Letters Patent is hereby corrected as shown below:

Column 10, line 16 (Claim 15), cancel the text and insert the following:

--15. A mounting bracket for mounting and vertically leveling a post on a planar surface; wherein the post includes a shaft extending perpendicularly upwardly and outwardly away from an upper surface of an adjustment plate; and wherein the mounting bracket comprises: a trim assembly including a peripheral wall and a movable portion; wherein the trim assembly includes a recessed area having a floor and the adjustment plate is adapted to be received within the recessed area; and wherein the movable portion is disposed inwardly of said peripheral wall and comprises a base plate receivable within the recessed area, said base plate having a lower face disposed adjacent the floor and an upper face adapted to be disposed adjacent a lower surface of the adjustment plate; and an adjustment device selectively engageable with the movable portion of the trim assembly to cause the movable portion to move relative to the peripheral wall, thereby causing a change in the orientation of the adjustment plate.--

Column 10, line 53 (Claim 19) change the phrase "to thereby chage the orientation" to read --to thereby change the orientation--.

Column 11, line 19 (Claim 25) change the phrase "includes four adjustments bolts" to read --includes four adjustment bolts--.

Signed and Sealed this
Twenty-sixth Day of July, 2011

David J. Kappos

David J. Kappos
*Director of the United States Patent and Trademark Office*